US005746499A

United States Patent [19]

Ratcliffe et al.

[11] Patent Number: 5,746,499

[45] Date of Patent: May 5, 1998

[54] FOOTWEAR WITH PULSED LIGHTS

[75] Inventors: William R. Ratcliffe, Santa Monica; Don C. Lawrence, Los Angeles, both of Calif.

[73] Assignee: L.A. Gear, Inc., Santa Monica, Calif.

[21] Appl. No.: 235,592

[22] Filed: Apr. 28, 1995

(Under 37 CFR 1.47)

[51] Int. Cl.[6] ..... A43B 23/00; F21L 15/08

[52] U.S. Cl. ..... 362/103; 362/234; 36/137

[58] Field of Search ..... 362/103, 234, 362/251, 276, 800, 802; 36/136, 137

[56] References Cited

U.S. PATENT DOCUMENTS

| | | | |
|---|---|---|---|
| 4,848,009 | 7/1989 | Rodgers | 36/137 |
| 5,052,131 | 10/1991 | Rondini | 36/137 |
| 5,188,447 | 2/1993 | Chiang et al. | 362/103 |
| 5,303,485 | 4/1994 | Goldston et al. | 36/137 |
| 5,357,697 | 10/1994 | Lin | 36/137 |
| 5,502,903 | 4/1996 | Barker | 36/137 |

FOREIGN PATENT DOCUMENTS

| | | | |
|---|---|---|---|
| 522882 | 1/1993 | European Pat. Off. | 36/137 |

*Primary Examiner*—Alan Cariaso
*Attorney, Agent, or Firm*—Graham & James LLP

[57] ABSTRACT

A device for use in footwear for producing pulsed light can be disposed in the sole of a shoe. The device includes a circuit having a switch responsive to pressure from the wearer's foot that activates a lighting circuit for a predetermined period of time or until the switch is operated again. The lighting circuit produces a pulsed light visible exteriorly of the sole of the shoe. The circuit can be controlled to operate either when the wearer's foot is brought into contact with, or when it is removed from, the ground.

26 Claims, 4 Drawing Sheets

FOOTWEAR WITH PULSED LIGHTS

FIELD OF THE INVENTION

This invention relates to footwear in general, and in particular, to footwear with lights that pulse to enhance the visibility of the wearer.

BACKGROUND OF THE INVENTION

Footwear having lighting devices incorporated therein are known. Lighting devices have been incorporated into a variety of footwear, including dress shoes, athletic shoes, boots, sandals, etc. Reasons for including lighting devices in footwear include permitting the wearer to see or be seen in reduced light situations, to provide special effects during entertainment events, or as an element of fashion on the part of the wearer.

There are several known implementations of footwear lighting devices. The most basic implementation involves the use of a light source, (e.g. an incandescent bulb, a neon tube, or a light emitting diode ("LED")), a portable power supply, such as a battery, and a manually operated on-off switch. These elements are connected as an electric circuit and are located in a convenient location in the footwear, such as within the sole, the heel, and/or the tongue structures.

A more complex implementation of lighted footwear includes the provision of a switching circuit to switch the light on and off in association with the presence or the absence of the wearer's foot in the shoe, or the contact or impact of the wearer's foot with the ground.

A third implementation involves the use of a so-called "motion switch" that is utilized to detect the angular position of the wearer's foot. The detection of a predetermined angular position of the shoe relative to the plane of the ground causes the light to illuminate. Such a motion switch may involve the use of a "tilt switch," i.e., a mercury switch, to sense the angular position of the shoe with respect to the gravity gradient to activate the circuit at a particular attitude of the shoe.

There are several shortcomings associated with footwear that incorporate lighting systems in accordance with the above-discussed implementations. Shoes that provide for continuous illumination of the lighting device tend to exhaust their batteries more quickly than those that are "on" only intermittently. Shoes that utilize lighting devices that illuminate only when the foot is in contact with the ground or at a certain angular position relative to it are not as effective in providing for increased visibility of the wearer for several reasons.

In addition, many of the prior art footwear lighting systems are complex, and hence, relatively more expensive. The greater the number of parts involved in such a circuit directly increases the chances for manufacturing defects and other factory related errors. With more components, undesirable weight is added to the shoes, and more space can be required to accommodate the lighting circuit, thereby reducing the structural integrity of the shoe.

Further, it is often undesirable for a wearer to have a light source in a shoe that is continuously "on" when pressure is being applied to the lighting device, or alternatively, when pressure is continuously absent therefrom. That is, in footwear that incorporates a pressure responsive switching mechanism, the switch activates the light source when pressure is applied to, or alternatively, removed from the switch, and the light remains "on" continuously until the pressure is either removed from, or alternatively, re-applied to the switch. In such a situation, the light source in the shoe can remain illuminated for extended periods of time, resulting in shortened battery life and/or inconvenience to the wearer occasioned by the need to manually deactivate the light system during such periods. This situation may occur, for example, when the wearer stands in one place for an extended period of time, or in the alternative switching mode, crosses a leg while sitting.

Further, in footwear that illuminates only upon contact with the ground, the light occasionally may not be fully visible, due to its being randomly obscured by material at ground level. In addition, if footwear emits light only while the shoe is in momentary contact with the ground, illumination typically occurs when the lighting device is in an essentially static condition, i.e., not moving. It is well known that lights that move and/or that flash on and off are more readily visible to third parties.

There are two psychophysical phenomena that act to insure that moving or flashing lights will be more readily seen than static ones: First, in a static field, a moving object is more easily detected by the eye than a static one. Second, under appropriate lighting conditions, a moving point source of light is perceived, due to the phenomenon of "persistence," by the human eye (and some cameras) as an elongated streak of light that is "painted" on the retina of the eye by the point source, rather than as a small, moving point of light.

Further, footwear incorporating the above-discussed lighting implementations can be expensive to manufacture and produce, due to the added cost of the lighting system incorporated therein. Such lighting systems can include relatively expensive electrical components and complicated switching mechanisms that require a large investment in components and testing.

Finally, such shoes are typically unsuitable for serious athletic activities. This is due to the relative fragility of the lighting mechanism itself, the reduced structural integrity of the shoe caused by the incorporation of the lighting device, and occasionally, an unacceptable increase in the weight of the shoe. Further, the incorporation of a mechanical switching element in the shoe can sometimes result in discomfort to the wearer of the shoe in those instances in which the physical presence and/or operation of the switch is easily felt or otherwise physically sensed by the wearer.

Thus, there is a need for a lighted shoe that incorporates a small, economical, yet reliable lighting system that illuminates when the wearer's foot either first contacts or first leaves the ground, and which then remains on for a brief, predetermined period of time, thereby increasing the likelihood that the light source will be lit while above the ground and/or moving, thereby enhancing the visibility of the wearer, and which thereafter extinguishes itself until reactivated, thereby avoiding premature exhaustion of the battery. Such a shoe needs to be capable of being manufactured in a cost-efficient and simplified manner, but must be suitable for wear in typical athletic activities without sacrificing ruggedness, performance, and weight factors to accommodate the lighting system.

SUMMARY OF THE INVENTION

The present invention overcomes the problems of the prior art described above and enhances the visibility of the wearer by the provision of a simple, economical and reliable design for a footwear lighting system that "pulses," or illuminates, for a predetermined period of time after the wearer's foot first contacts the ground, or alternatively, for a predetermined period after the wearer's foot first leaves the ground, thereby increasing the likelihood that the light source will be above the ground and/or moving when the lights are "on," and which then turns "off" after such period, thereby conserving battery life.

The preferred embodiment of the present invention includes an electronic circuit having relatively few, inexpensive components that accomplishes the above-discussed features. By incorporating fewer components, the reliability of the lighting circuit can be increased, while reducing the costs of its manufacture. In addition, the use of a simplified electronic circuit enables the overall size of the lighting circuit to be reduced, thus enhancing the structural integrity of the shoe by reducing the structural modifications to the shoe necessary to accommodate the lighting system.

The above and other features and advantages of the present invention will become more readily apparent upon a reading of the detailed description of the preferred embodiments of the present invention, particularly if read in conjunction with the accompanying drawings, a brief description of which follows hereinafter. However, it should be clear that the present invention is in no way limited to the embodiments shown in the drawings. The present invention is solely limited by the claims which are appended to this specification. In the following discussion, like reference numbers refer to like components.

DESCRIPTION OF THE PREFERRED EMBODIMENTS

Figure 1:
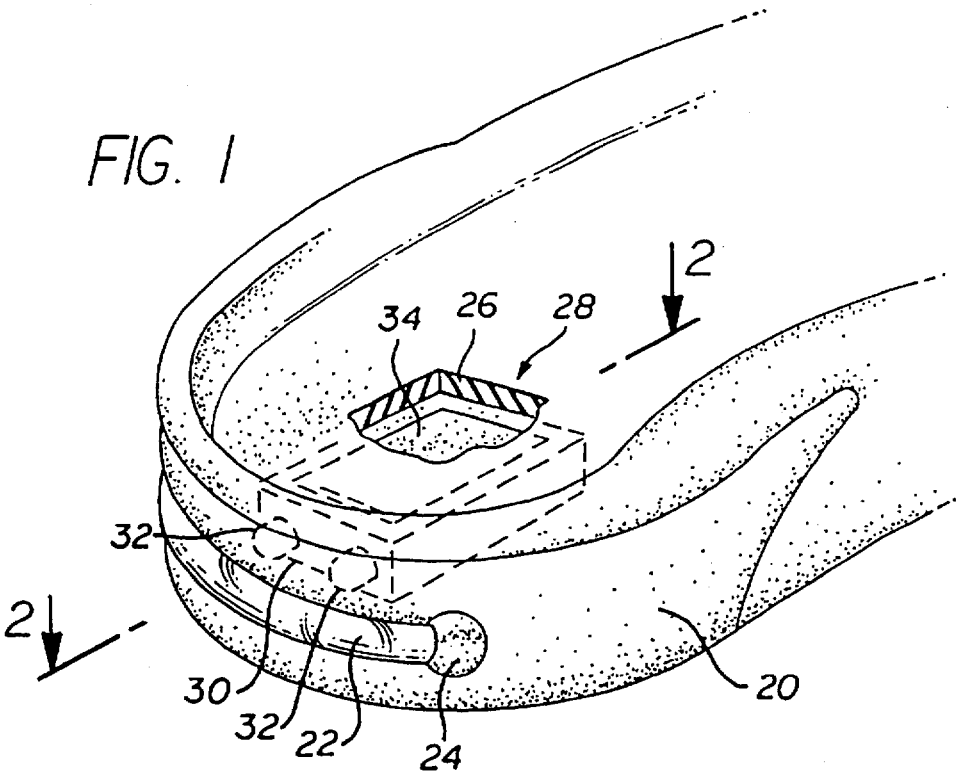
FIG. 1 is a partial perspective view of a sole of a shoe incorporating the novel lighting design of the present invention.
Figure 2:
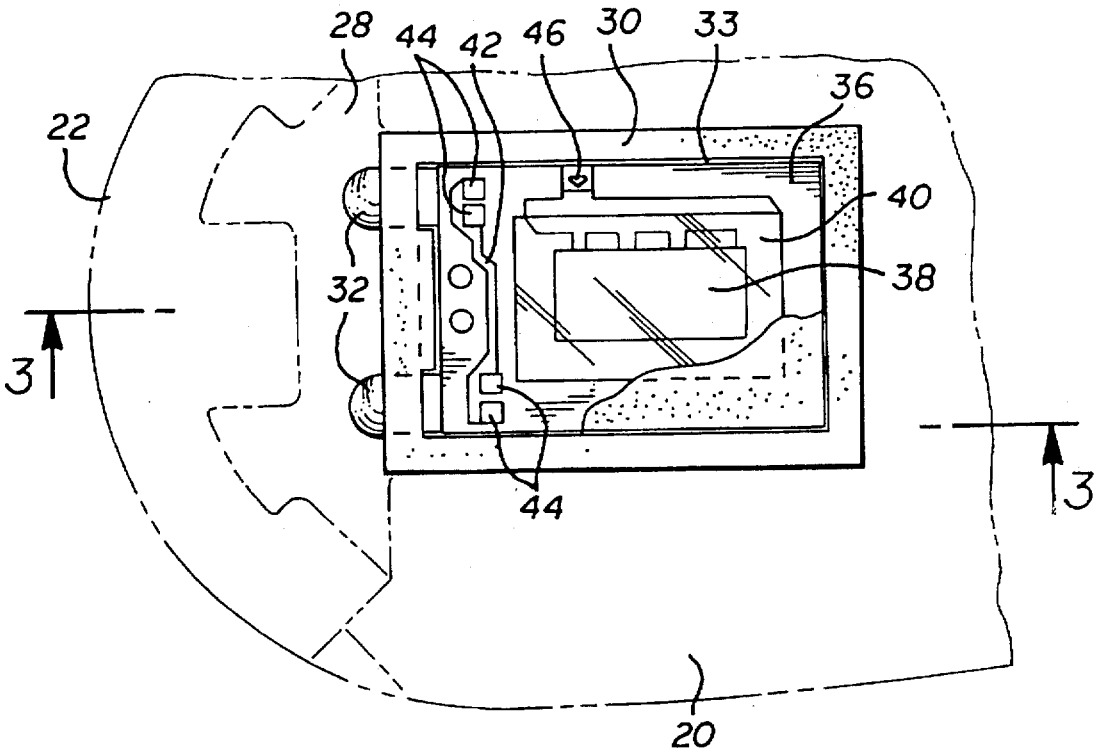
FIG. 2 is a partial cross-sectional top view of the sole of the shoe incorporating the novel lighting design of the present invention taken along the lines 2—2 of FIG. 1.

The following discussion of the preferred embodiments of the present invention focuses on athletic shoes, and in particular, the incorporation of the novel lighting system in the midsole 20 of an athletic shoe. While athletic shoes are used for purposes of describing the preferred embodiments of the invention, it should be understood that the present invention is not limited to use with athletic shoes, but is suitable for use in all types of footwear, including, but not limited to, work shoes, children shoes, dress shoes, walking shoes, and specialty footwear.

Referring to FIGS. 1–4, the exemplary preferred embodiment of the present invention is illustrated in the context of footwear that includes an upper (not shown), typically made of leather, nylon fabric, or other suitable, flexible material, and a resilient midsole or sole 20. The sole 20 is preferably formed in an injection-molding or thermoforming process from a foamed, resilient, synthetic material, such as ethylene vinyl acetate (EVA), or polyurethane (PU), either of which is capable of providing support for the wearer of the footwear and resiliency to absorb impacts associated with normal walking and running activities.

In an athletic shoe, the sole 20 typically comprises a midsole provided with an outsole (not shown) attached at a lower surface thereof. The outsole is typically molded from a solid, wear-resistant material, such as rubber and certain polyurethane materials. The use of the solid material for the outsole provides for greater durability, as the typical midsole material tend to wear relatively poorly when exposed to contact with ground surfaces. An insole 21 can be positioned above the sole 20 for additional wearer comfort.

In the exemplary embodiment illustrated, the sole includes a lens structure 22 disposed at a rear portion thereof, and one or more thumb grooves 24 are formed in the sole material 20 to enable the wearer to access the lens structure 22 for its easy insertion and removal. The lens structure 22 may be held in place in the sole 20 through a friction fit, an over-center locking arrangement, or more permanently, may be suitably adhered to the midsole material.

In the exemplary embodiment shown in FIGS. 1–4, the sole 20 incorporates a so-called "cup-sole" type of construction, in which the sole 20 is formed as an upwardly-facing cup into which the upper portion of the shoe is received during attachment of the two respective portions. The side walls of the sole cup may be extended upwardly to lap and adhere to the upper portion for added lateral support of the foot and to provide enhanced adhesion with the upper.

For illustration purposes, the sole 20 of the exemplary embodiment is shown with a cutout portion 26, which reveals a cavity 28 formed in the sole 20 adapted to receive therein a light module 30. The light module 30 preferably includes a plurality of light emitting diodes (LEDs) 32 protruding therefrom. While the preferred embodiment of the present invention uses light emitting diodes, any suitable, low-power-consumption light source, including incandescent, neon, etc., light sources would be suitable for use with the present invention. The light generated by the LEDs 32 is conveyed exteriorly of the shoe by the lens structure 22, which is preferably formed of a clear plastic or other suitable light-conducting material.

The light module 30, which is preferably formed of a pliable, resilient rubber or plastic material, is provided with a flexible cover 34. The lighting module 30, which may be formed in an injection molding process, may also be formed of other suitable materials, such as plastic, fiberglass, etc., that are capable of supporting therein a lighting circuit for controlling operation of the LEDs 32. The light module 30 has a bottom surface 35 and a cavity 33 that contains the light circuit.

The light circuit preferably includes a printed circuit board 36 having disposed thereon a pressure sensitive switch 38, conductive layers 40, 42, for conducting power from a power source, such as battery 48, to a plurality of LED contacts 44, as well as a control circuit 54 and a plurality of terminal contacts 46, which provide contact locations for connecting the battery 48 to the printed circuit board 36.

The battery 48 may be connected to the terminal contacts 46 using battery support leads 50, 52, which serve both to support the battery 48 and to provide electrical connections between the positive and negative terminals of the battery 48 and the printed circuit board 36. The LEDs 32 connect to the LED contacts 44 through a plurality of LED connector leads 45.

In the preferred embodiment of the present invention, the battery 48 is comprised of a standard, 3-volt, lithium "button" cell, similar to that found in electronic games, calculators, etc. However, it should be understood that other battery types and form factors, such as "AAA" nickel-cadmium, nickel-metal-hydride, alkaline, etc., dry cells may be utilized in place of the coin-shaped lithium battery shown, in an appropriate design. The LEDs are relatively low-power-consumption light sources such that, under normal wear conditions, and in the context of the power-conserving circuit of the present invention, the useful life of the battery can exceed the useful life of the shoe, and hence, should not need replacing. In the preferred embodiment, the light module 30 is permanently installed in the sole 20 in a cavity 28 molded in the sole material, and is affixed therein with a suitable adhesive. Alternatively, the lens 22 can be held in place via a friction-fit, or over-center locking mechanism, to allow the wearer access to the light module in an embodiment in which the light module 30 is removable in a plug-in, plug-out fashion for easy maintenance, repair, battery replacement, etc.

Figure 3:
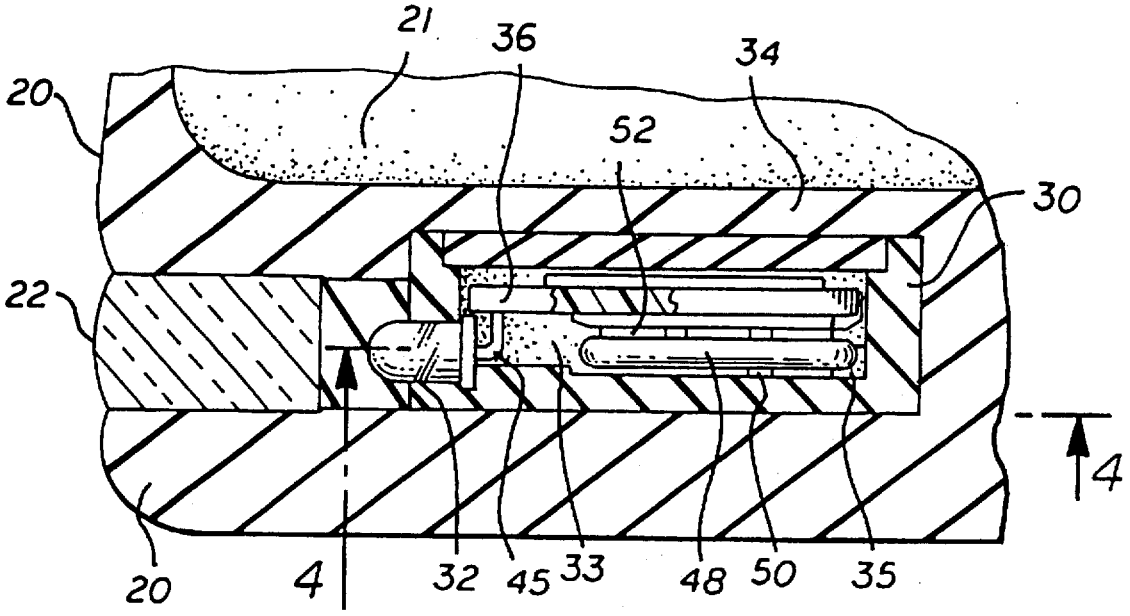
FIG. 3 is a partial cross-sectional side view of the sole of the shoe incorporating the novel lighting design of the present invention taken along the lines 3—3 of FIG. 2.
Figure 4:
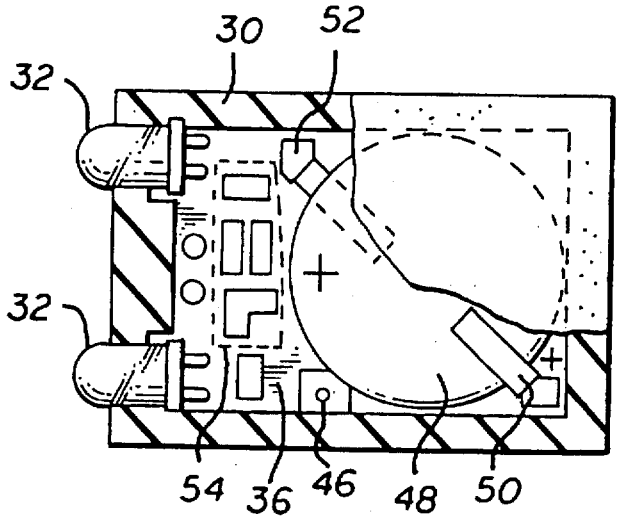
FIG. 4 is a bottom view of a preferred embodiment of a lighting module incorporated in the sole shown in FIG. 1, taken the lines 4—4 of FIG. 3.

The thicknesses of the sole materials overlying and underlying the module 30, as best seen in FIG. 3, coupled with the resilient nature of the module 30 in the preferred embodiment, are such that the module 30 is typically not noticeable by the wearer of a shoe in which the light module 30 is incorporated. Further, such shoes typically incorporate a resilient insole to support the wearer's feet, thus further decreasing the wearer's ability to feel the module 30 with the foot. The pressure switch 38 is preferably a membrane switch, which is disposed on an upper surface of the circuit board 36.

Preferably, the switch 38 is disposed on an upper surface of the circuit board 36, substantially adjacent the cover 34 of the module 30 when the module is disposed in the sole 20. Without pressure being applied to the module 30, the cover 34 essentially abuts the switch 38 but does not activate it. In response to pressure from the wearer's foot, the cover 34 of the module 30 is displaced downwardly, thereby causing pressure to be applied to the membrane switch 38. The membrane switch 38 responds to the pressure by switching from an "open," or non-conducting, condition, to a "closed," or conducting, state. The change in the conductivity of the membrane switch, which is virtually undetectable by the wearer, causes the light circuit to switch on and off in the manner described in more detail below without the wearer noticing. It should be noted that the thicknesses of the sole 20 and the insole 21 overlaying the module 30 are selected so as not to interfere with the operation of the switch 38.

Figure 5:
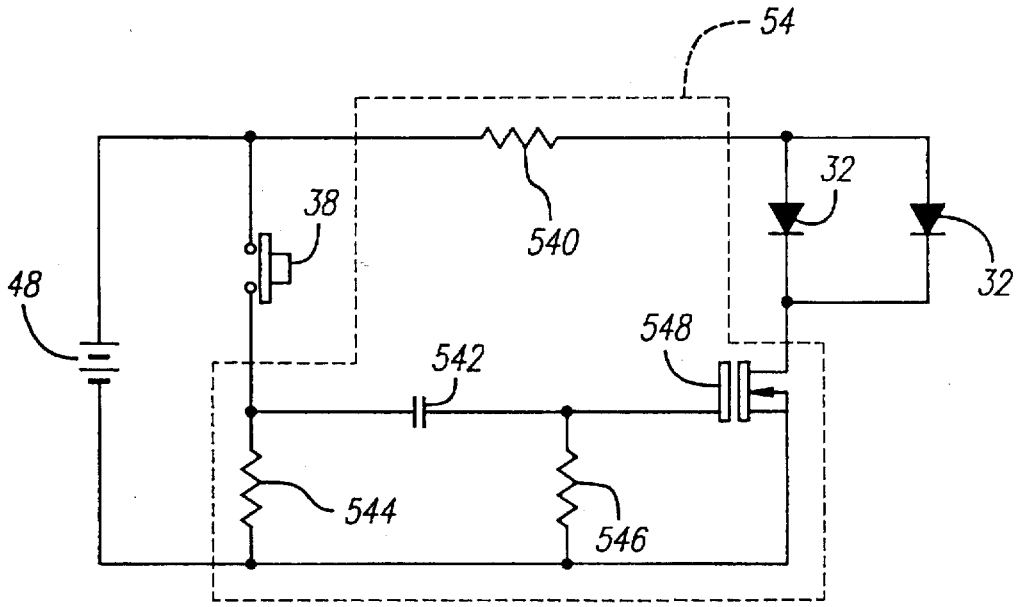
FIG. 5 is a schematic diagram of a preferred embodiment of a lighting control circuit for use with a shoe incorporating the novel lighting design of the present invention.

The control circuit 54, which is shown in schematic form in FIG. 5, includes a 25 ohm (Ω) current limiting resistor 540 connected at one end thereof with the switch 38 and battery 48, and at the other end thereof to the LEDs 32. The resistor 540 serves to limit the current supplied to the LEDs 32. The drain of an enhancement mode metal oxide semiconductor field effect transistor (FET) 548 is connected to the other end of the LEDs 32. The FET, which acts as a driver for the LEDs, is operated in the "switch mode," i.e., it is normally "OFF," or in a non-conducting state, until an appropriate turn-on voltage is applied to the gate thereof, thereby turning it "ON" and causing it to be in a conductive state.

A 0.22 microfarad ("μf") capacitor 542 is connected with the gate of the FET 548 and to a first end of each of two, 1-megohm ("MΩ") resistors 544 and 546. The first resistor 544 is connected at a first end thereof to the capacitor 542 and to one side of the switch 38. The second resistor 546 is connected at a first end thereof to the capacitor 542 and the gate of the FET 548. The second ends of both resistors are both tied to the negative terminal of the battery 48 and the source of the FET 548, all of which are commonly tied to electrical ground.

The operation of the lighting control circuit 54 illustrated is as follows. In the quiescent state, with the wearer standing still in the shoe, the switch 38 will be in the closed condition. If the capacitor 542 is fully charged, no current can flow into the gate of the FET 548, and thus, the FET 548 will not conduct. The FET 548 is therefore "off," and the LEDs 32 are likewise "off." As soon as the wearer removes pressure from switch 38, such as by taking a step, or by jumping, the switch 38 opens. This permits the capacitor 542 to discharge through the resistor 544 at a rate defined by the RC time constant defined by the capacitor 542 and the resistor 546, in this case, 0.22 seconds. It will be noted that, while switch 38 is closed, the first end of the resistor 544 is maintained at a potential of 3 volts by the battery 48, thereby preventing the capacitor 542 from discharging.

Upon landing, or other re-application of pressure to the switch 38, the switch 38 closes. This permits current to flow through the capacitor 542, causing it to charge at a rate defined by the same RC time constant (i.e., the capacitance of capacitor 542, multiplied by the resistance of resistor 546) described above. It will be noted that a discharged capacitor is initially a "short circuit" when current is first applied to it. Thus, as soon as the switch 38 closes, the voltage at the gate of the FET 548 (connected to the node defined by capacitor 542 and resistor 546) is almost instantaneously at the same voltage as the battery, in this case, 3 volts. The FET 548 thus turns on and the LEDs 32 light up.

As the capacitor 542 charges, the voltage at the gate of the FET 548 begins to drop. A capacitor, when fully charged, does not pass current. Thus, when the gate voltage drops below the level needed to maintain the FET 548 in an ON state, it will turn OFF and stop conducting. This will occur in approximately 0.22 seconds for the component values discussed above. The circuit is thus again in the quiescent state. Accordingly, what is provided by circuit 54 is a timer that uses the switching capabilities of the FET 548 to switch the LEDs on and then off again in a predetermined manner.

One feature of the circuit shown in FIG. 5 is its operation for a predetermined period of time after the switch 38 has been operated, in order to "pulse" the LEDs 32 "on" for such period. After the predetermined period of time, the FET no longer conducts, due to the charging of the capacitor, and the LEDs cease illumination. In addition, if the switch 38 is re-opened (such as when the wearer lifts a foot) during the charging of the capacitor 542, the capacitor will quickly drain any acquired charge through resistor 544, and the FET will no longer conduct, since the voltage at the gate of the FET will be zero. Thus, the operation of the LEDs is controlled both by the RC time constant of the circuit and the switch 38.

Figure 8:
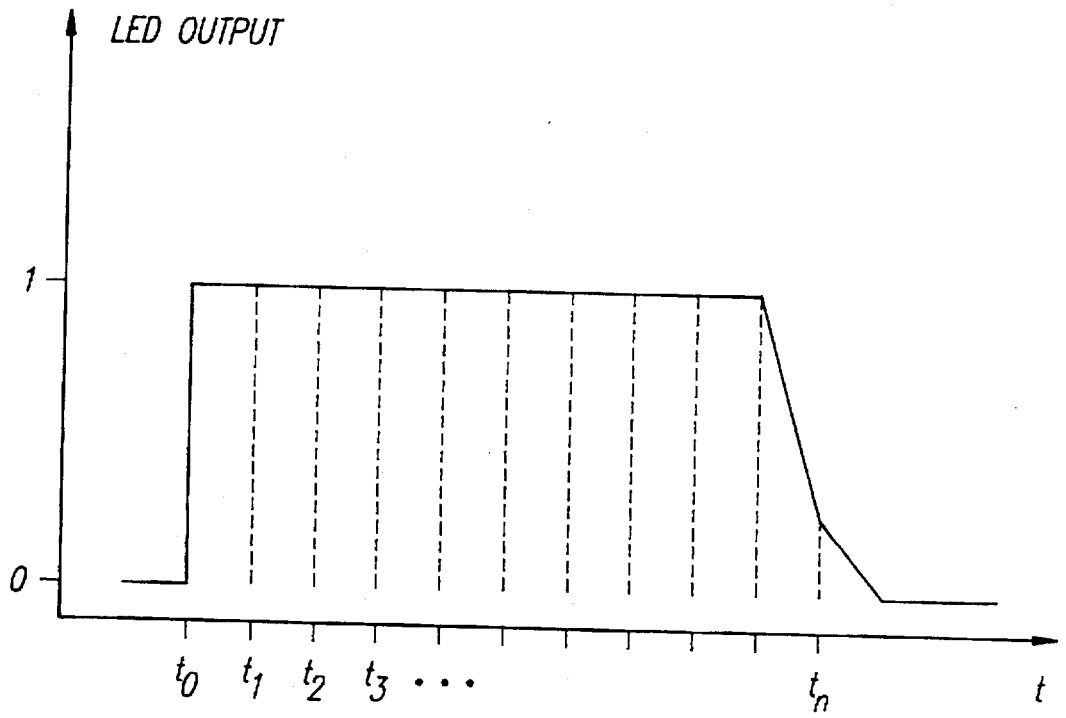
FIG. 8 is a timing diagram for use with the embodiments of the invention shown in FIGS. 5, 6 and 7.

This, essentially "digital," operation can be seen with reference to FIG. 8, which shows the initiation of illumination of the LEDs 32 at time $t_0$, where the LED output goes from "0", or "off", to "1", or "on". The LEDs remain "on", i.e., lit, for a predetermined period of time, and then cease illumination at time $t_n$. In the embodiment shown in FIG. 5, $t_n$=0.22 seconds. However, as skilled practitioners will readily recognize, the RC time constant for the circuit 54, and hence, the value of $t_n$, can easily be modified, one way or the other, by an appropriate adjustment of the respective values of the capacitor 542 and the resistor 546.

Figure 6:
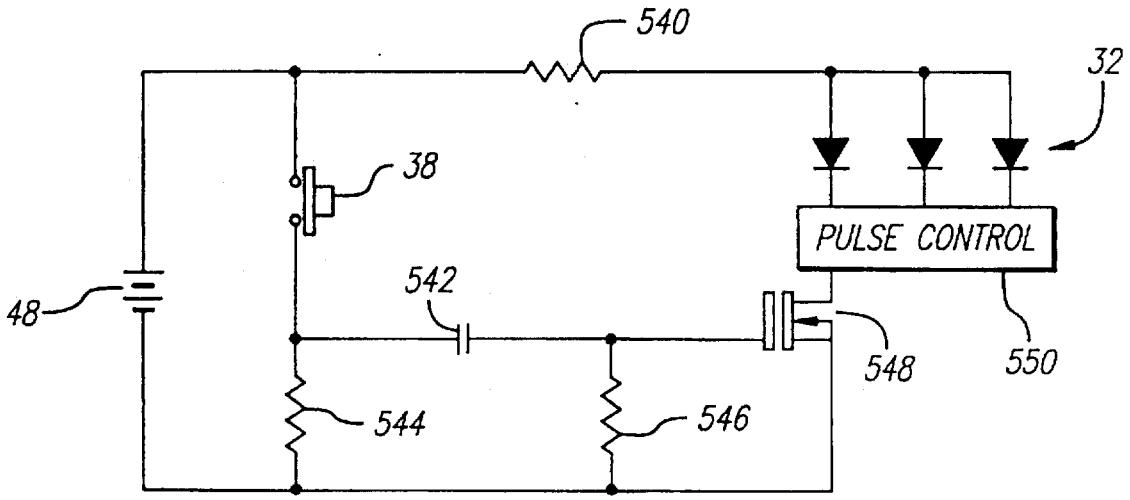
FIG. 6 is a schematic diagram of an alternative embodiment of the lighting control circuit shown in FIG. 5.

As an alternative embodiment to that shown schematically in FIG. 5, it is possible to use the FET 548 to switch a flasher control circuit, or oscillator, such as the device 550 shown in FIG. 6. The flasher control circuit 550 preferably comprises a Vitelic VH215 LED Flasher circuit, which is a known, monolithic integrated circuit that is fabricated using a metal gate Complementary Metal-Oxide Semiconductor (CMOS) process. While other suitable oscillator circuits may be used with the present invention, the VH215 is a preferred device for use in flashing the LEDs 32 because of its selectably-different modes of operation, as described more fully below.

The VH215 circuit has multiple flash modes, including a "one-shot" mode and an "on/off" mode for flashing a series of connected LEDs. In the one-shot mode, the VH215 responds to the grounding of a selected input to the circuit by providing for either a sequential or a random flashing of the LEDs for 12 or 24 flashes. In the on/off mode, the VH215 will perform either a sequential or a random flash of the LEDs for as long as an on/off "trigger" is tied to ground.

In the preferred embodiment, the VH215 is set to the on/off mode and the FET 548 is used as the on/off trigger. The length of time the on/off trigger is tied to ground is controlled by the RC time constant defined by the capacitor 542 and the resistor 546, as described above in connection with the first embodiment. In this fashion, after the capacitor 542 is discharged upon a first operation of the switch 38 (e.g., the wearer jumps), a sequential flashing of the LEDs is initiated upon the next operation of switch 38 when the gate of the FET 548 is supplied with voltage, due to the capacitor 542 initially behaving as a short in the manner discussed above. The length of time that the on/off trigger of the VH215 is tied to ground, and thus, "on", is controlled by the factory-selectable RC time constant and the switch 38 in the same manner as described above.

As can be seen in FIG. 8, with the circuit shown in FIG. 6, the LEDs 32 can be made to flash on and off at a predetermined rate for a predetermined period of time. That is, as shown in FIG. 8, the LEDs 32 will flash "on" at time $t_0$, "off" at time $t_1$, "on" at time $t_2$, "off" at time $t_3$, and so on, for the prescribed length of time determined by the RC time constant discussed above. The rate of flashing will depend on the oscillator rate of the pulse control circuit 550, which is also factory selectable.

While the Vitelic VH215 is the preferred flashing control circuit 550, those skilled in the art will recognize that any suitable oscillator circuit may be substituted for the VH215 circuit to provide for the flashing of the LEDs 32 for a predetermined period of time. As with the VH215 circuit, the operation of the oscillator will be determined by the factory selectable RC time constant and the switch 38 in the same manner as discussed above.

Figure 7:
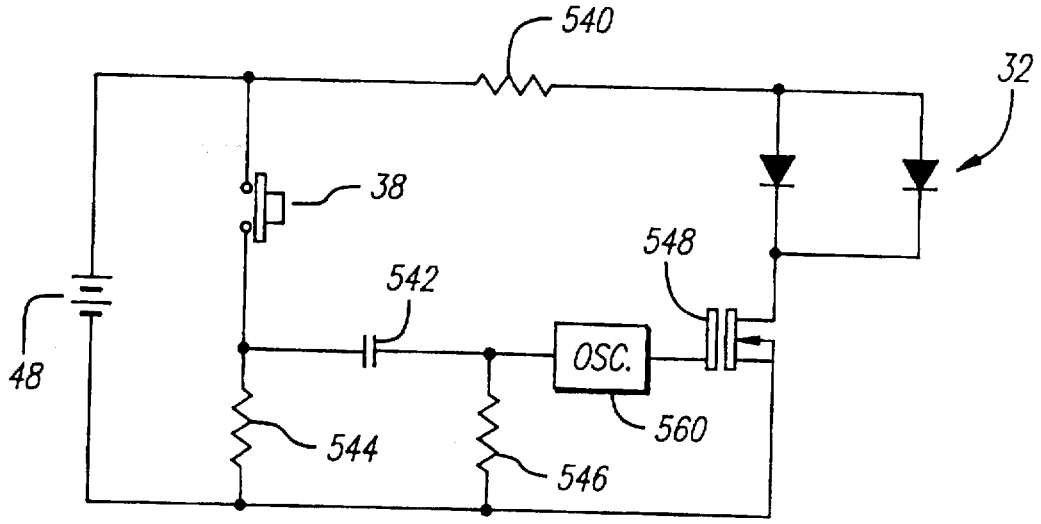
FIG. 7 is a schematic diagram of an alternative embodiment of the lighting control circuit shown in FIG. 5.

FIG. 7 shows the use of a generic oscillator circuit for causing the LEDs 32 to flash at a predetermined rate in a manner similar to that discussed above with reference to FIG. 6. In FIG. 7, an oscillator circuit 560 is disposed between the capacitor 542 and the FET 548. In this embodiment, with a discharged capacitor 542, and when the switch 38 is operated, the oscillator circuit 560 is provided with an input voltage equal to the voltage on the battery 48. Upon receipt of this input voltage, the oscillator circuit 560 provides a stream of pulses at a desired frequency to the gate of the FET 548. The pulse stream, in turn, causes the FET 548 to switch between a conducting and a non-conducting state at a rate equal to the frequency of the oscillator 560. This, in turn, causes the LEDs 32 to flash on and off at a frequency equal to that of the oscillator 560. This is represented in FIG. 8 by the dashed lines.

As with the embodiments of the invention shown in FIGS. 5 and 6, the oscillator circuit 560 will remain "on", and thus produce flashes in the LEDs, until the input voltage thereto drops below a threshold voltage of the oscillator circuit 560, due to the charging of the capacitor 542, or until the switch 38 is again operated, whichever occurs first. While any suitable oscillator circuit 560 may be utilized with the present invention, such circuits being known to those skilled in the art, it is preferred that a low-power-consumption oscillator be utilized to increase the life of the battery 48.

While the above discussed embodiments of the present invention have been described using "enhancement mode" field effect transistors, one skilled in the art will readily recognize that "depletion mode" field effect transistors can also be utilized to good effect. The operation of the circuit can also be altered using the depletion mode transistors such that the lighting circuit is operative to light when the wearer's foot is lifted from the ground, as opposed to when the wearer's foot contacts the ground.

In addition, the exemplary embodiments of the present invention described above employ an RC time constant of 0.22 seconds, as defined by the 0.22 μf capacitor 542 and the one MΩ resistor 546. Those skilled in the art will readily recognize that the RC time constant can be varied by changing the values for the capacitor 542 and/or the resistor 546 to make the period, or pulse, during which the LEDs 32 flash on and off, shorter or longer, as desired.

Further, while the preferred embodiments illustrate the placement of the lighting module 30 in the heel area of the shoe generally below the calcaneus, or large heel bone, of the wearer's foot, one skilled in the art will readily recognize that the lighting module may be disposed at almost any desired location within the shoe. For example, it is possible to locate the switching mechanism in other positions, such as the toe area or arch area of the shoe, without departing from the scope of the present invention.

In addition, it should be understood that it is not necessary for the lighting devices such as LEDs 32 to be located adjacent to the lighting module 30, as shown in the exemplary preferred embodiment. The lighting devices may be positioned at any desired location about the shoe and connected with the lighting module 30 by means of thin wires, or flat, flexible conductors. Thus, lights may be positioned on the front, top, sides, tongue or upper of the shoe, as well as or in addition to, the rear of the shoe, as shown in the drawings.

Of course, those skilled in the art will readily appreciate that numerous other modifications and/or additions can be made to the above-discussed features of the present invention without departing from its spirit. It is intended that all such modifications and/or alternative embodiments, including those discussed above, fall within the scope of the claims appended below.

What is claimed is:

1. An illuminating apparatus for use in footwear including a sole and a cavity formed in the sole, the illuminating apparatus providing a pulsed light visible exteriorly of the footwear, the apparatus comprising:

a light source mounted in said cavity such that light emitted from said source is visible exteriorly of said footwear;

a power source operative connected with said light source for providing power for energizing said light source;

switch means for initiating illumination of said light source, said switch means being operatively connected with said power source and operatively responsive to close when pressure is applied to said switch means and to open when pressure is removed from said switch means, wherein said switch means is a pressure switch; and timing means, operatively responsive to said switch means, for causing illumination of said light source for a predetermined period of time after pressure is applied to said switch means.

2. The illuminating apparatus of claim 1, wherein said timing means is further operatively responsive to said switch means to stop illumination of said light source upon a subsequent removal of pressure from said switch means before an expiration of said predetermined period of time.

3. The illuminating apparatus of claim 2, wherein said switch means comprises a normally open switch, said switch being responsive to pressure to close in response to a force exerted on said switch, and being disposed in a heel portion of said footwear between the wearer's foot and the ground such that, when the wearer's weight is applied to the ground through the agency of said sole portion, a force is exerted on said switch, thereby closing said switch, and when the wearer's weight is removed from the ground, the force exerted on said switch is removed, thereby returning said switch to said normally open condition.

4. The illuminating apparatus of claim 3, wherein said switch means comprises a membrane switch.

5. The illuminating apparatus of claim 1, wherein said timing means comprises:

a pair of first and second resistors having first and second ends, the first end of said first resistor being connected with said switch means, and the second ends of said first and second resistors being tied to electrical ground;

a capacitor connected between the first ends of said first and second resistors and being electrically connected with said power source when said switch means is closed, said capacitor storing an electrical charge in response to the closing of said switch means, and discharging said electrical charge in response to an opening of said switch means; and a switchable conducting element having a first lead connected with said capacitor and said first end of said second resistor, a second lead connected with said light source, and a third lead connected with said electrical ground, said switchable conducting element being responsive to an input on said first lead thereof to enable current to flow between said second and third leads thereof.

6. The illuminating apparatus of claim 5, wherein said switchable conducting element responds to a removal of said input on said first lead to prevent the flow of current between said second and third leads thereof.

7. The illuminating apparatus of claim 6, wherein said capacitor is responsive to an opening of said switch means to discharge any stored electrical charge therein, and said capacitor is responsive to a subsequent closing of said switch means to supply an electrical charge as an input to said first lead of said switchable conducting element for a predetermined period of time.

8. The illuminating apparatus of claim 7, wherein said predetermined period of time is determined by values of said capacitor and said second resistor.

9. The illuminating apparatus of claim 5, wherein said switchable conducting element comprises a field effect transistor.

10. The illuminating apparatus of claim 9, wherein said switchable conducting element comprises an enhancement mode field effect transistor.

11. The illuminating apparatus of claim 1, wherein said light source comprises a light emitting diode.

12. The illuminating apparatus of claim 11, wherein said light source comprises a plurality of light emitting diodes.

13. The illuminating apparatus according to claim 1, further including a lens, disposed in a side surface of said sole, for conducting light from said light source to a position exterior of said sole.

14. The illuminating apparatus of claim 1, wherein the power source comprises a lithium battery.

15. The illuminating apparatus of claim 1, further including oscillator means for flashing said light source on and off at a predetermined rate for said predetermined period of time.

16. An apparatus for use in footwear for providing a pulsed light visible exteriorly of the footwear, the apparatus comprising:

a light source for producing light visible exteriorly of said footwear;

a power source operative connected with said light source for providing power for energizing said light source;

a timing circuit for generating a timing signal for controlling a duration of illumination of said light source;

a first switch for controlling said timing circuit, said first switch being operatively connected with said power source and operatively responsive to close when pressure is applied to said first switch and to open when pressure is removed from said first switch; and a second switch, operatively connected with said light source and switchable between a conducting and a non-conducting state in accordance with said timing signal, for enabling illumination of said light source when said second switch is in said conducting state and preventing illumination of said light source when said second switch is in said non-conducting state.

17. The apparatus of claim 16, wherein said timing circuit responds to said first switch to produce said timing signal in response to a closing of said first switch, said timing circuit stopping production of said timing signal after a predetermined period of time, said second switch being responsive to a presence of said timing signal to switch from said non-conducting state to said conducting state.

18. The apparatus of claim 16, wherein said first switch comprises a pressure sensitive membrane switch.

19. The apparatus of claim 18, wherein said second switch comprises a transistor.

20. The apparatus of claim 19, wherein said transistor comprises a field effect transistor.

21. The apparatus of claim 19, wherein said light source comprises a light emitting diode.

22. The apparatus of claim 21, wherein said light source comprises a plurality of light emitting diodes.

23. The apparatus of claim 16, wherein said timing circuit comprises:

a pair of first and second resistors, each having first and second ends, the first end of said first resistor being connected with said first switch, the first end of said second resistor being connected to said second switch, and the second ends of said first and second resistors being tied to electrical ground; and, a capacitor connected between the first ends of said first and second resistors and being electrically connected with said power source when said first switch is closed, said capacitor storing an electrical charge in response to the closing of said first switch and discharging said electrical charge in response to an opening of said first switch.

24. The apparatus of claim 23, wherein the predetermined period of time is determined in accordance with a time constant defined by said capacitor and said second resistor.

25. The apparatus of claim 16, further including oscillator means, disposed between said first and second switches and responsive to an operation of said first switch, for causing said second switch to oscillate at a predetermined rate between said conducting state and said non-conducting state.

26. The apparatus of claim 16, further including oscillator means, responsive to an operation of said first switch, for causing said light source to flash on and off at a predetermined rate.

* * * * *